US008079768B1

(12) United States Patent
McLaughlin

(10) Patent No.: US 8,079,768 B1
(45) Date of Patent: Dec. 20, 2011

(54) APPARATUS FOR DELIVERING PAINT TO A PAINT ROLLER DIRECTLY FROM A PAINT CAN WITH A COMPARTMENT FOR HOLDING A PAINT BRUSH

(76) Inventor: Thomas McLaughlin, New York, NY (US)

( * ) Notice: Subject to any disclaimer, the term of this patent is extended or adjusted under 35 U.S.C. 154(b) by 1215 days.

(21) Appl. No.: 11/821,210

(22) Filed: Jun. 22, 2007

(51) Int. Cl.
*A46B 11/00* (2006.01)
*A46B 17/08* (2006.01)

(52) U.S. Cl. ..... 401/122; 401/121; 401/123; 401/125

(58) Field of Classification Search ..... 401/121–123, 401/125; 220/697–699
See application file for complete search history.

(56) References Cited

U.S. PATENT DOCUMENTS 2,921,330 A * 1/1960 Prytikin ..... 401/122
3,809,484 A 5/1974 Bradshaw
4,287,631 A 9/1981 Marrs
4,865,282 A 9/1989 Yonkman et al.
5,054,947 A 10/1991 Frank et al.
5,335,392 A 8/1994 Evans
5,515,567 A 5/1996 Washburn
5,546,628 A 8/1996 Silvera
5,626,319 A 5/1997 Fusillo
6,419,194 B1 7/2002 LoSacco et al.
6,866,172 B2 * 3/2005 Shackelford ..... 220/695
2005/0269469 A1 12/2005 Cummins
2006/0064836 A1 3/2006 Mowe
2006/0113310 A1 6/2006 Hawkins
* cited by examiner

*Primary Examiner* — Tuan Nguyen
(74) *Attorney, Agent, or Firm* — Richard L. Miller

(57) ABSTRACT

An apparatus for delivering paint to a paint roller directly from a paint can with a compartment for holding a paint brush which comprises a housing. A mechanism is for securing the housing to an exterior surface of a cylindrical side wall of the paint can. A roller wiper component is also provided. Another mechanism is for mounting the roller wiper component on the housing to extend over the paint can. After a roller cover of the paint roller is charged with paint contained in the paint can, excessive paint on the roller cover of the paint roller will be removed therefrom by the roller wiper component to safely drip back into the paint can.

6 Claims, 5 Drawing Sheets

Fig. 1
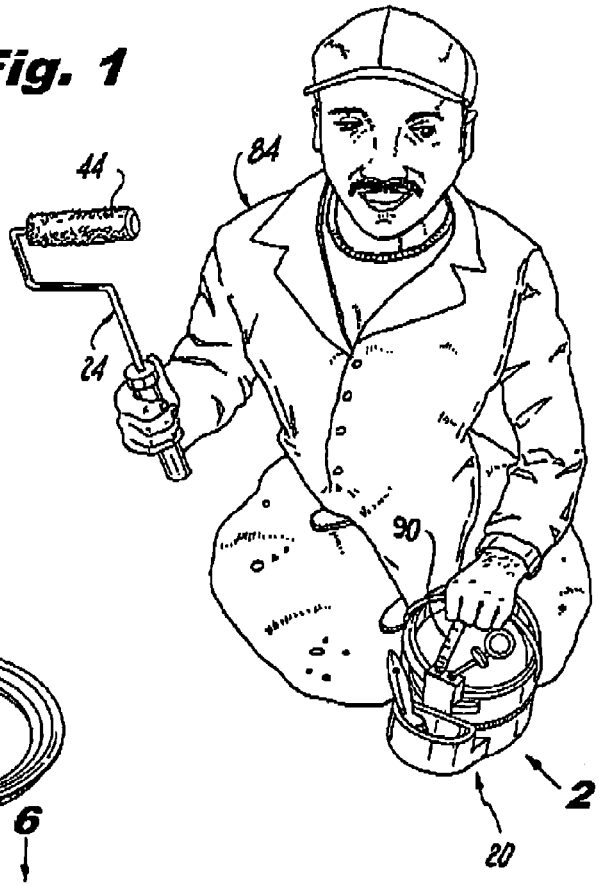
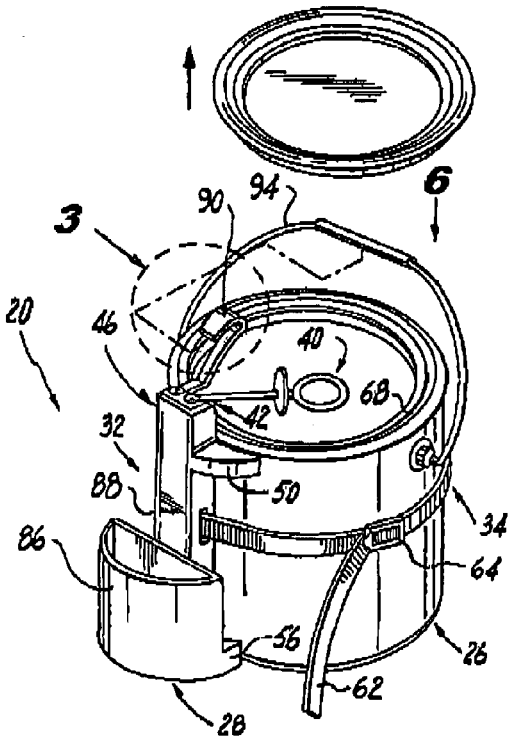
Fig. 2

APPARATUS FOR DELIVERING PAINT TO A PAINT ROLLER DIRECTLY FROM A PAINT CAN WITH A COMPARTMENT FOR HOLDING A PAINT BRUSH

BACKGROUND OF THE INVENTION

1. Field of the Invention

The present invention relates to a paint roller, and more particularly, an apparatus for delivering paint to a paint roller directly from a paint can with a compartment for holding a paint brush.

2. Description of the Prior Art

Numerous innovations for paint equipment have been provided in the prior art that will be described. Even though these innovations may be suitable for the specific individual purposes to which they address, however, they differ from the present invention.

A FIRST EXAMPLE, U.S. Pat. No. 3,809,484, Issued on May 7, 1974, to Bradshaw teaches a convenient and efficient supply device for delivering paint from a conventional container through a line which includes a first flexible hose, a manual pump, a second flexible hose, and a manifold, to the exterior of a conventional paint roller. The manifold can be used in either of two operating positions at opposite sides of the plane defined by the roller handle and the roller axis, and it can be instantly shifted at will from either one of these positions to the other. The line includes two interchangeable hoses of radically different lengths running, respectively, from source to pump and from pump to manifold. One arrangement disposes the pump for hand operation, the other for foot operation. A faucet attaching fitting at the introductory end of the line enables the line to be quickly and cleanly flushed out under pressure. Adaptation to rollers of different lengths is brought about by selection for use of a manifold corresponding in length to the length of the roller.

A SECOND EXAMPLE, U.S. Pat. No. 4,287,631, Issued on Sep. 8, 1981, to Marrs teaches a spring metal rod that is bent in the general shape of an elongated U having opposed concave curves in the sides of the U-shape and having outwardly inclined sides with opposed inwardly bent end bars at the upper portion of the U-shape. The distance between the concave curves in the sides of the U-shape and the closed end of the U-shape is great enough to permit the closed end of the U-shape to be grasped in the hand. The opposed concave sides are used to grip the paint roller while the paint remover is moved parallel to the axis of the roller to squeeze paint out of the roller. The opposed end bars are used to grip the bristles of the paint brush while the paint remover is moved longitudinally with respect to the brush to squeeze paint out of the bristles.

A THIRD EXAMPLE, U.S. Patent Office Document No. 4,865,282, Issued on Sep. 12, 1989, to Yonkman et al. teaches a combination paint roller wiper and paintbrush holder that comprises a wiping surface with a plurality of hooks to hang the wiping surface in a paint bucket. The wiping surface is connected to a projection that engages the wall of the bucket when a paint roller is wiped on the wiping surface. The combination also includes a support structure for a paintbrush or the like that is attached to the wiping structure on the side opposite from the wiping surface. The support structure may be attached permanently to the wiping portion, or it may be made removable. The bottom portion of the paintbrush holder is made of a solid material with drain holes to support a standing paintbrush without damage to the bristles. The paintbrush holder also has a perforated front wall, perforated side walls and a perforated rear wall.

A FOURTH EXAMPLE, U.S. Pat. No. 5,054,947, Issued on Oct. 8, 1991, to Frank et al. teaches a self-contained power painting system in which a battery operated motor and pump are contained in a lid for a paint reservoir, and that entire unit is adapted to be carried on a user by a strap or belt. A paint applicator, such as a brush or roller, is connected to the pump by a flexible conduit and includes a switch activator at the applicator to permit the user to selectively control operation of the pump and to move about freely while painting without being encumbered by a relatively immobile paint reservoir or power source connection through extension cords.

A FIFTH EXAMPLE, U.S. Pat. No. 5,335,392, Issued on Aug. 9, 1994, to Evans teaches a tool for stripping excess paint from a paint roller that is an arcuate hook having the radius of the paint roller. The hook is set on a handle at an angle for the user to use the hook against the paint roller to strip paint out of it in longitudinal strokes. Preferably the arc is a semi-circle.

A SIXTH EXAMPLE, U.S. Pat. No. 5,515,567, Issued on May 14, 1996, to Washburn teaches a hand operated paint roller cleaning apparatus which extracts residual reusable paint. Mechanically advanced by a one-way drive the roller brush is conveyed longitudinally through the aperture. The aperture supports a circular wiper which has a interference fit when contacting with the nap of the roller. The trigger handle when compressed increments the roller through the aperture expelling the paint and wringing the roller nap.

A SEVENTH EXAMPLE, U.S. Pat. No. 5,546,628, Issued on Aug. 20, 1996, to Silvera teaches a versatile paint carrier comprising a box-shaped paint receptacle having an open top for holding paint therein. A first perforated basket is mounted in a vertical position to an inner surface of a side wall of the paint receptacle, so that paint can drip from bristles of paint brushes stored in the first perforated basket back into the paint receptacle. A second perforated basket is mounted in a vertical position to an inner surface of a rear wall of the paint receptacle, so that paint can drip from a roller of a paint roller stored in the second perforated basket back into the paint receptacle.

AN EIGHTH EXAMPLE, U.S. Pat. No. 5,626,319, Issued on May 6, 1997, to Fusillo teaches an improved paint brush holder constructed from a single piece of plastic which spans the opening of a conventional paint can. On each end of the holder are hooked shaped fingers which secure to the perimeter receptacle of a conventional paint can. A slat which spans the paint can opening provides a surface area available for dragging a paint brush across allowing removal of excess paint. The inclined surface directs the excess paint to flow back into the paint can. The slat further provides a location for holding the paint brush wherein the wet portion of the brush is placed on the slat allowing excess paint to drip back into the container while the brush rests over the side of the can for ease of grasping. A horizontally disposed tab engages the underside of the perimeter receptacle which works in conjunction with the hook shaped ends to prevent movement of the device. The hooked shaped ends deform during lid replacement allowing for sealed storage of the device within the paint container.

A NINTH EXAMPLE, U.S. Pat. No. 6,419,194 B1, Issued on Jul. 16, 2002, to Losacco et al. teaches a paint brush holder that has a basal member curved to follow the curve of the rim of a paint container to which the paint brush holder is attached by depending clamp jaws spaced apart circumferentially along the curve of the basal member. A clip member has a depending shaft extending through a guideway in the basal member and clip jaws for holding a paint brush over the interior of the container. Complementary detents secure the clip member within the basal member at a selected altitudinal location so as to maintain the paint brush at a selected elevation within the interior of the container.

A TENTH EXAMPLE, U.S. Patent Office Document No. 2005/0269469 A1, Published on Dec. 8, 2005, to Cummins teaches a paint brush holder that is for resting a paint brush over a paint container, with the paint brush bristles suspended over the inner portion of the open paint container. The paint brush holder when attached to the rim of a paint container, allows the user to rest the paint brush in the paint brush holder and allows the principle of inertia of the paint brush, acting on two points to create a grip on the paint brush handle. Further points of the paint brush holder restrict lateral movement of the paint brush. The paint brush holder can be used with a variety of types and sizes of the paint brush, and can be fitted to a variety of types and sizes of the paint container, the paint brush holder being of spring content.

AN ELEVENTH EXAMPLE, U.S. Patent Office Document No. 2006/0064836 A1, Published on Mar. 30, 2006, to Mowe teaches a tool for pushing excess paint or other liquid sources off of a paint roller sleeve without having to remove the sleeve. The tool comprises a handgrip, an elongated rod and a generally circular loop formed as a single, unitary piece of a straight section of rod. Disposed away from the handgrip, the loop, is slip fitted over the sleeve of the roller. Excess paint can be removed by inserting the sleeve in the circular section of the tool. This can be done while holding the paint roller in one hand and the cleaning tool in the other hand and then the tool is slipped over the sleeve. The tool can either be slipped over the open end of the roller or over the frame of the roller or the roller can be inserted through a narrow gap defined by the loop and with a forward and aft motion, the excess paint is then squeezed from the sleeve and with forward and aft motion the excess paint is squeezed from the sleeve.

A TWELFTH EXAMPLE, U.S. Patent Office Document No. 2006/0113310A1, Published on Jun. 1, 2006, to Hawkins teaches a paint brush holder that includes a body removably attachable to a paint container. A gripping element is supported on the body so as to be positioned over the open top of the container. The gripping element releasably grips the handle portion of the paint brush along the length thereof, so that the position of the paint brush is vertically adjustable.

It is apparent now that numerous innovations for paint equipment have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an apparatus for delivering paint to a paint roller directly from a paint can with a compartment for holding a paint brush that avoids the disadvantages of the prior art.

ANOTHER OBJECT of the present invention is to provide an apparatus for delivering paint to a paint roller directly from a paint can with a compartment for holding a paint brush that is simple and inexpensive to manufacture.

STILL ANOTHER OBJECT of the present invention is to provide an apparatus for delivering paint to a paint roller directly from a paint can with a compartment for holding a paint brush that is simple to use.

BRIEFLY STATED, STILL YET ANOTHER OBJECT of the present invention is to provide an apparatus for delivering paint to a paint roller directly from a paint can with a compartment for holding a paint brush which comprises a housing. A mechanism is for securing the housing to an exterior surface of a cylindrical side wall of the paint can. A roller wiper component is also provided. Another mechanism is for mounting the roller wiper component on the housing to extend over the paint can. After a roller cover of the paint roller is charged with paint contained in the paint can, excessive paint on the roller cover of the paint roller will be removed therefrom by the roller wiper component to safely drip back into the paint can.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic perspective view of an embodiment of the present invention installed on a paint can and ready for use by a painter;

FIG. 2 is an enlarged diagrammatic perspective view taken in the direction of arrow 2 in FIG. 1, with the lid exploded from the paint can;

A MARSHALLING OF REFERENCE NUMERALS UTILIZED IN THE DRAWING

Figure 3:
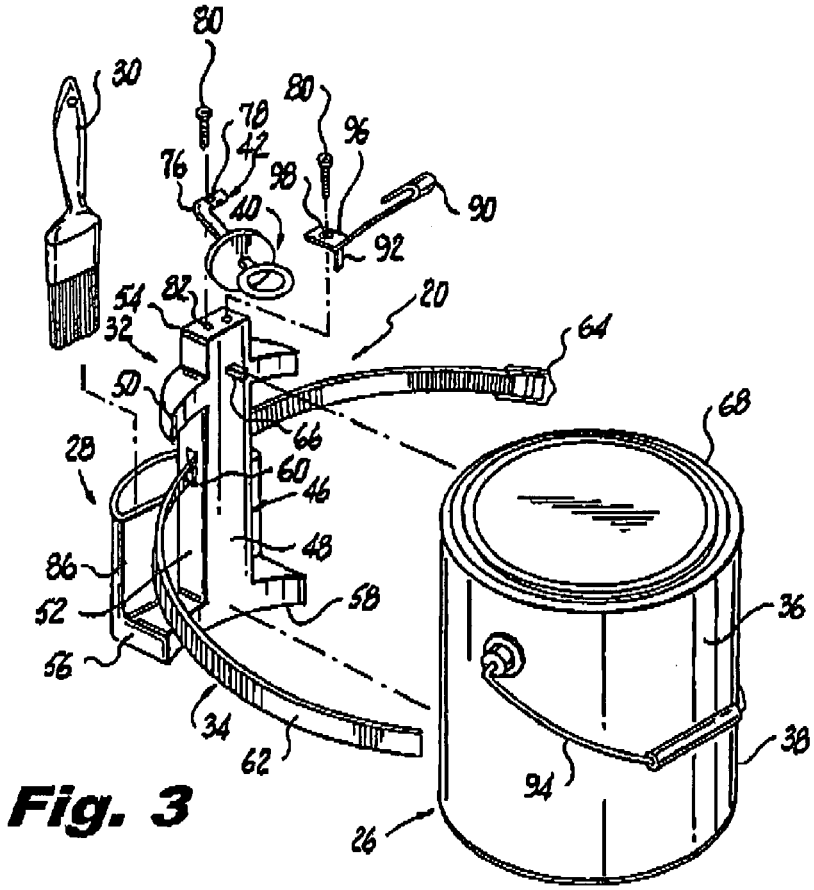
FIG. 3 is an exploded diagrammatic perspective view, showing the present invention ready to be installed on the paint can.
Figure 4:
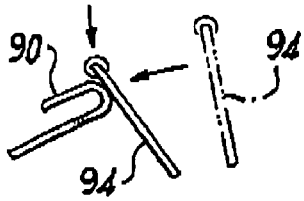
FIG. 4 is a diagrammatic side elevational view, of the area enclosed in the dotted circle indicated by arrow 3 in FIG. 2, showing the bail disengaged from the spring hook clip.
Figure 5:
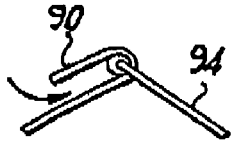
FIG. 5 is a diagrammatic side elevational view, of the area enclosed in the dotted circle indicated by arrow 3 in FIG. 2, showing the bail engaged from the spring hook clip.
Figure 6:
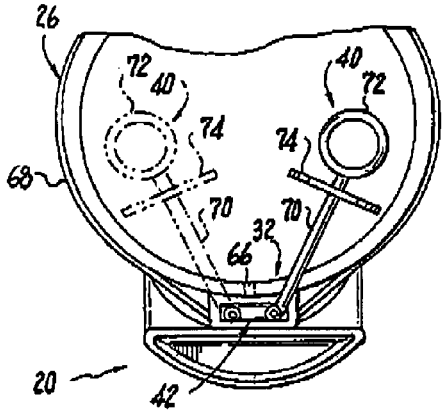
FIG. 6 is a diagrammatic top elevational view taken in the direction of arrow 6 in FIG. 2, with the paint can broken away, showing how the roller wiper component will be mounted in either one of two positions, but with bail 94 and spring clip 90 omitted for clarity.

20 apparatus
22 paint
24 paint roller
26 paint can
28 compartment of apparatus 20
30 paint brush
32 housing of apparatus 20
34 securing mechanism of apparatus 20
36 exterior surface of cylindrical side wall 38
38 cylindrical side wall of paint can 26
40 roller wiper component of apparatus 20
42 mounting mechanism of apparatus 20
44 roller cover of paint roller 24
46 stanchion of housing 32
48 curved rear wall of stanchion 46
50 upper curved arm of stanchion 46
52 side wall of stanchion 46
54 top end of stanchion 46
56 lower curved arm of stanchion 46
58 lower end of stanchion 46
60 transverse aperture in stanchion 46
62 strap of securing mechanism 34
64 fastener on strap 62
66 projection of apparatus 20
68 rim of paint can 26
70 elongated rod of roller wiper component 40
72 ring on elongated rod 70
74 paint stop member on elongated rod 70
76 offset bracket on elongated rod 70
78 aperture in offset bracket 76
80 screw
82 threaded bore in top end 54 of stanchion 46
84 painter
86 cup of apparatus 20
88 front wall of stanchion 46
90 spring hook clip of apparatus 20
92 maintaining mechanism for spring hook clip 90
94 bail of paint can 26
96 flange on spring hook clip 90
98 hole in flange

DETAILED DESCRIPTION OF THE PREFERRED EMBODIMENT

Figure 7:
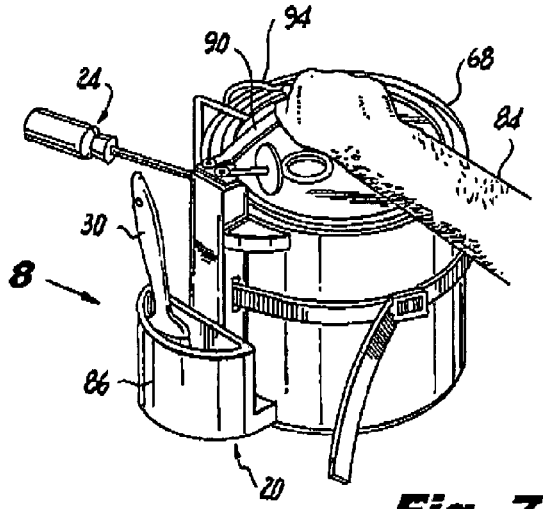
FIG. 7 is a diagrammatic perspective view similar to FIG. 2, with the roller cover of the paint roller being stored within the paint can and the lid placed loosely upon the rim of the paint can.
Figure 8:
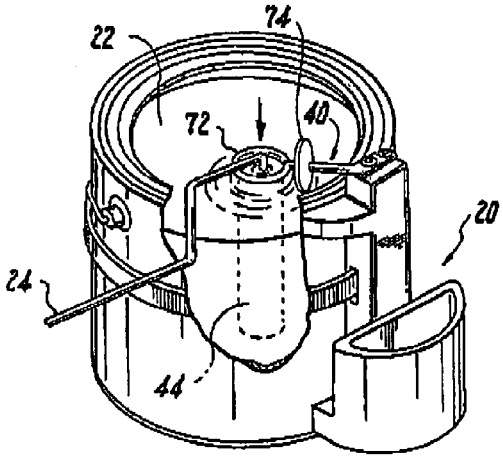
FIG. 8 is a diagrammatic perspective view taken in the direction of arrow 8 in FIG. 7 with parts broken away, showing the roller cover of the paint roller being submerged in a nearly full paint can.
Figure 9:
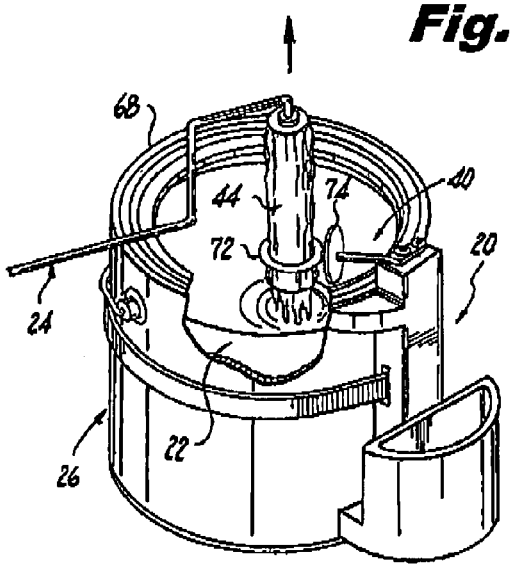
FIG. 9 is a diagrammatic perspective view similar to FIG. 8, showing the roller cover of the paint roller being removed from the nearly full paint can and having the excess paint squeezed therefrom by the ring of the roller wiper component.
Figure 10:
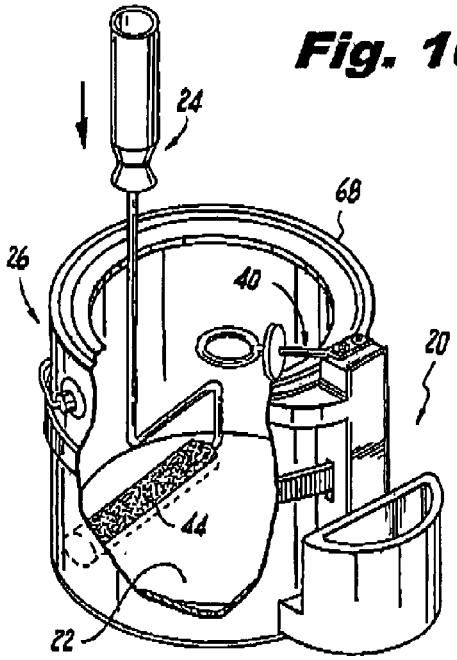
FIG. 10 is a diagrammatic perspective view similar to FIG. 9, showing the roller cover of the paint roller being submerged in a nearly empty paint can.
Figure 11:
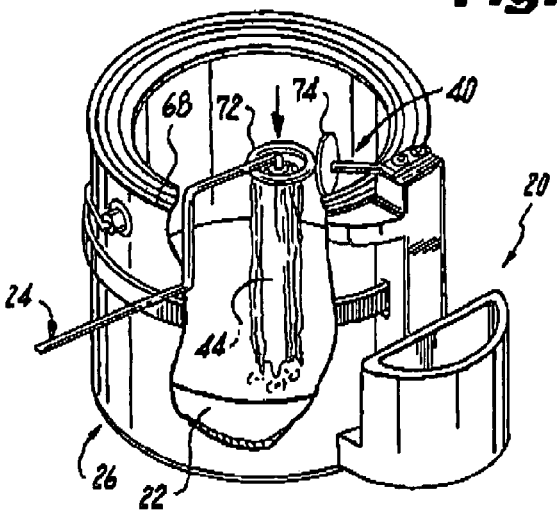
FIG. 11 is a diagrammatic perspective view similar to FIG. 10, showing the roller cover of the paint roller being inserted through the ring of the roller wiper component.
Figure 12:
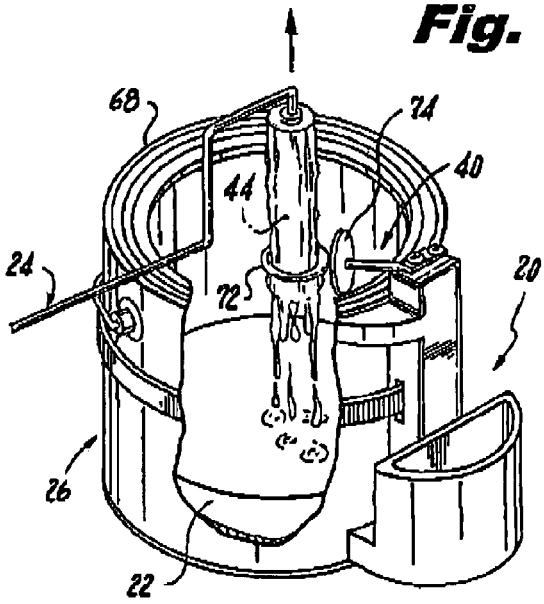
FIG. 12 is a diagrammatic perspective view similar to FIG. 11, showing the roller cover of the paint roller being removed from the nearly empty paint can and having the excess paint squeezed therefrom by the ring of the roller wiper component.

Referring now to the figures, in which like numerals indicate like parts, and particularly to FIGS. 1 through 12, which are a diagrammatic perspective view of an embodiment of the present invention installed on a paint can and ready for use by a painter; an enlarged diagrammatic perspective view taken in the direction of arrow 2 in FIG. 1, with the lid exploded from the paint can; an exploded diagrammatic perspective view showing the present invention ready to be installed on the paint can; a diagrammatic side elevational view, of the area enclosed in the dotted circle indicated by arrow 3 in FIG. 2, showing the bail disengaged from the spring hook clip; a diagrammatic side elevational view, of the area enclosed in the dotted circle indicated by arrow 3 in FIG. 2, showing the bail engaging the spring hook clip; a diagrammatic top elevational view taken in the direction of arrow 6 in FIG. 2, with the paint can broken away, showing how the roller wiper component will be mounted in either one of two positions; a diagrammatic perspective view similar to FIG. 2, with the roller cover of the paint roller being stored within the paint can and the lid placed loosely upon the rim of the paint can; a diagrammatic perspective view taken in the direction of arrow 8 in FIG. 7 with parts broken away, showing the roller cover of the paint roller being submerged in a nearly full paint can; a diagrammatic perspective view similar to FIG. 8, showing the roller cover of the paint roller being removed from the nearly full paint can and having the excess paint squeezed therefrom by the ring of the roller wiper component; a diagrammatic perspective view similar to FIG. 9, showing the roller cover of the paint roller being submerged in a nearly empty paint can; a diagrammatic perspective view similar to FIG. 10, showing the roller cover of the paint roller being inserted through the ring of the roller wiper component; and a diagrammatic perspective view similar to FIG. 11, showing the roller cover of the paint roller being removed from the nearly empty paint can and having the excess paint squeezed therefrom by the ring of the roller wiper component, and as such, will be discussed with reference thereto.

The present invention is an apparatus 20 for delivering paint 22 to a paint roller 24 directly from a paint can 26 with a compartment 28 for holding a paint brush 30 which comprises a housing 32. A mechanism 34 is for securing the housing 32 to an exterior surface 36 of a cylindrical side wall 38 of the paint can 26. A roller wiper component 40 is also provided. Another mechanism 42 is for mounting the roller wiper component 40 on the housing 32, to extend over the paint can 26. After a roller cover 44 of the paint roller 24 is charged with paint 22 contained in the paint can 26, excessive paint 22 on the roller cover 44 of the paint roller 24 will be removed therefrom by the roller wiper component 40 to safely drip back into the paint can 26.

The housing 32, as best seen in FIG. 3, comprises a stanchion 46 having a curved rear wall 48 to bear against the exterior surface 36 of the cylindrical side wall 38 of the paint can 26. A pair of upper curved arms 50 are provided. Each upper curved arm 50 is integral with and extends from one opposite side wall 52 near a top end 54 of the stanchion 46 to bear against the exterior surface 36 of the cylindrical side wall 38 of the paint can 26. A pair of lower curved arms 56 are also provided. Each lower curved arm 56 is integral with and extends from one opposite side wall 52 at a lower end 58 of the stanchion 46 to bear against the exterior surface 36 of the cylindrical side wall 38 of the paint can 26. The pair of upper curved arms 50 and the lower curved arms 56 will stabilize the stanchion 46 against the exterior surface 36 of the cylindrical side wall 38 of the paint can 26.

The securing mechanism 34 comprises the stanchion 46 of the housing 32 having a transverse aperture 60 extending through the opposite side walls 52 approximately midway on the stanchion 46. A strap 62 is sized to fit through the transverse aperture 60 in the stanchion 46 and wrap about the exterior surface 36 of the cylindrical side wall 38 of the paint can 26. A fastener 64 on the strap 62 is for binding the strap 62 about the paint can 26. A projection 66 as shown in FIG. 3, extends from the curved rear wall 48 and near the top end 54 of the stanchion 46. The projection 66 will sit upon a rim 68 of the paint can 26 to prevent the stanchion 46 from sliding down on the exterior surface 36 of the cylindrical side wall 38 of the paint can 26.

The roller wiper component 40 comprises an elongated rod 70. A ring 72 is on a distal end of the elongated rod 70. The ring 72 has an inner diameter slightly larger than an outer diameter of the roller cover 44 of the paint roller 24. The ring 72 will remove the excessive paint 22 from the roller cover 24, when the roller cover 40 is pulled through the ring 72. A paint stop member 74 is affixed to the elongated rod 70 adjacent to the ring 72, to prevent the paint 22 from proceeding beyond the paint stop member 74.

The mounting mechanism 42 comprises an offset bracket 76 formed on the elongated rod 70 opposite from the ring 72, with the offset bracket 76 having an aperture 78 therethrough. At least one screw 80 extends through the aperture 78 in the offset bracket 76 and into one of two threaded bores 82 in the top end 54 of the stanchion 46. The offset bracket 76 can be flipped over allowing the elongated rod 70 to extend at an angle over the paint can 26, to accommodate a left handed or right handed painter 84. The apparatus 20 further comprises a cup 86 integral with a front wall 38 of the stanchion 46 opposite from the curved rear wall 48 at the lower end 58 of the stanchion 46. The cup 86 is sized to hold a paint brush 30 in a convenient manner therein.

The apparatus 20 as shown in FIGS. 1 through 5 and 7, further comprises a spring hook clip 90. A mechanism 92 is for maintaining the spring hook clip 90 on the top end 54 of the stanchion 46. The spring hook clip 90 will engage with a bail 94 of the paint can 26 to keep the paint can 26 in proper upright positions when the painter 84 grasps the bail 94 and lifts the paint can 26 up, thereby reducing the chance of spilling paint 22 from the paint can 26. The maintaining mechanism 92 comprises a flange 96 on an end of the spring hook clip 90. The flange 96 has a hole 98 therethrough. A screw 80 extends through the hole 98 in the flange 96 and into one of the two threaded bores 32 in the top end 54 of the stanchion 46.

It will be understood that each of the elements described above, or two or more together, may also find a useful application in other types of constructions differing from the types described above.

While the invention has been illustrated and described as embodiments of an apparatus for delivering paint to a paint roller directly from a paint can with a compartment for holding a paint brush, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus for delivering paint to a paint roller directly from a paint can with a compartment for holding a paint brush which comprises;

a) a housing;

b) means for securing said housing to an exterior surface of a cylindrical side wall of the paint can;

c) a roller wiper component;

d) means for mounting said roller wiper component on said housing to extend over the paint can so that after a roller cover of the paint roller is charged with paint contained in the paint can, excessive paint on the roller cover of the paint roller will be removed therefrom by said roller wiper component to safely drip back into the paint can, wherein said housing comprise;

e) a stanchion having a curved rear to bear against the exterior surface of the cylindrical side wall of the paint can;

f) a pair of upper curved arms, in which each said upper curved arm is integral with and extends from one opposite side wall near a top end of said stanchion to bear against the exterior surface of cylindrical side wall of the paint can;

g) a pair of upper curved arms, in which each said lower curved arm is integral with and extends from one opposite side wall a lower end of said stanchion to bear against the exterior surface of the cylindrical side wall of the paint can, wherein said pair of upper curved arms and said lower curved arms will stabilize said stanchion against the exterior surface of the cylindrical side wall of the paint can, wherein said securing means comprises:

h) said stanchion of said housing having a transverse aperture extending through said opposite side walls approximately midway on said stanchion;

i) a strap sized to fit through said transverse aperture said stanchion and wrap about the exterior surface of the cylindrical side wall of the paint can; and j) a fastener on said strap for binding said strap about the paint can, further comprising a projection extending from said curved rear wall and near said top end of said stanchion, so that said projection will sit upon a rim of the paint can to prevent said stanchion from sliding down on the exterior surface of the cylindrical side wall of the paint can.

2. The apparatus as recited in claim 1, wherein said roller wiper component comprises:

a) an elongated rod;

b) a ring on a distal end of said elongated rod, said ring having an inner diameter slightly larger than an outer diameter of the roller cover of the paint roller, wherein said ring will remove the excessive paint from the roller cover when the roller cover is pulled through the ring; and c) a paint stop member affixed to said elongated rod adjacent to said ring to prevent the paint from proceeding beyond said paint stop member.

3. The apparatus as recited in claim 2, wherein said mounting means comprises:

a) an offset bracket formed on said elongated rod opposite from said ring with said offset bracket having an aperture therethrough; and b) a screw to extend through the aperture in said offset bracket and into one of two threaded bores in said top end of said stanchion, so that said offset bracket can be flipped over allowing said elongated rod to extend at an angle over the paint can to accommodate a left handed or right handed painter.

4. The apparatus as recited in claim 3, further comprising a cup integral with a front wall of said stanchion opposite from said curved rear wall at said lower end of said stanchion, wherein said cup is sized to hold a paint brush in a convenient manner therein.

5. The apparatus as recited in claim 4, further comprising:

a) a spring hook clip; and b) means for maintaining said spring hook clip on said top end of said stanchion, so that said spring hook clip will engage with a bail of the paint can to keep the paint can in proper upright position when the painter grasps the bail and lifts the paint can up, thereby reducing the chance of spilling paint from the paint can.

6. The apparatus as recited in claim 5, wherein said maintaining means comprises:

a) a flange on an end of said spring hook clip, said flange having a hole therethrough; and b) a screw which extends through said hole in said flange and into one of the two threaded bores in said top end of said stanchion.

US 8,079,768 B1
9 10

* * * * *